United States Patent [19]

Lundgren

[11] 4,350,499

[45] Sep. 21, 1982

[54] VAPOR SEPARATING METHOD AND APPARATUS

[75] Inventor: Rolf B. Lundgren, Sundsvall, Sweden

[73] Assignee: Sunds Defibrator Aktiebolag, Sundsvall, Sweden

[21] Appl. No.: 236,494

[22] Filed: Feb. 20, 1981

[30] Foreign Application Priority Data

Feb. 27, 1980 [SE] Sweden ..... 8001538

[51] Int. Cl.[3] ..... B01D 45/14; B02C 23/02

[52] U.S. Cl. ..... 55/1; 55/319; 55/403; 55/432; 162/18; 241/247

[58] Field of Search ..... 55/1, 191, 319, 401, 55/403, 430, DIG. 14, 432; 162/18; 241/246, 247

[56] References Cited

U.S. PATENT DOCUMENTS

| | | | |
|---|---|---|---|
| 2,354,796 | 8/1944 | Clark | 55/430 |
| 2,572,063 | 10/1951 | Skipper | 55/191 |
| 4,082,233 | 4/1978 | Reinhall | 241/247 |
| 4,163,651 | 8/1979 | Dohnauk | 55/432 |

FOREIGN PATENT DOCUMENTS

| | | | |
|---|---|---|---|
| 2150003 | 3/1980 | Fed. Rep. of Germany | 55/430 |
| 46079 | 9/1962 | Poland | 55/430 |

*Primary Examiner*—David L. Lacey

*Attorney, Agent, or Firm*—Lerner, David, Littenberg & Samuel

[57] ABSTRACT

Methods and apparatus for separating vapor from refined cellulosic material are disclosed. The method includes discharging the refined cellulosic material downwardly through an inlet opening into a discharge chamber maintained at substantially the same pressure as the refiner, deflecting the vapor laterally with respect to that cellulosic material, passing the vapor through the discharge chamber at a flow rate of less than 15 meters/sec. so that the cellulosic material carried by the vapor is separated from the vapor by sedimentation, and discharging the cellulosic material from the discharge chamber. The apparatus includes a discharge chamber with an inlet and an outlet, and a portion laterally disposed with respect to the inlet, a conveyor for moving the cellulosic material laterally towards the discharge chamber outlet to create a substantially gas-tight plug of cellulosic material in order to maintain the discharge chamber substantially at the pressure at which the cellulosic material is refined, the conveyor permitting the vapor to pass laterally with respect to the inlet opening and a vapor outlet located in the portion of the discharge chamber laterally disposed with respect to the inlet.

10 Claims, 2 Drawing Figures

VAPOR SEPARATING METHOD AND APPARATUS

FIELD OF THE INVENTION

The present invention relates to methods and apparatus for separating vapor from lignocellulose-containing materials. More particularly, the present invention relates to method and apparatus for separating vapor from such material which has been processed in a refiner under pressure, so as to utilize the heat content in the vapor, such as for hot water generation.

BACKGROUND OF THE INVENTION

During the manufacture of refiner-mechanical or thermo-mechanical fiber pulps, the lignocellulose-containing materials being processed in the refiner are supplied with a considerable amount of energy, and the moisture which follows along with that material is repidly vaporized, since a temperature above 100° C. is usually generated by the friction therein. Thus, valuable heat leaves the process and in fact has to be conducted away from it, since if this is not done disturbances in the material flow between the refining discs will generally occur.

During separation of these vapors one of the difficulties encountered is that the processed material is usually discharged to an apparatus which operates at a pressure which is considerably lower than the pressure prevailing in the refiner. Thus, vapors can follow along with this material and be lost. An additional problem is to insure that vapors are efficiently separated so that the fiber content remaining therein is relatively low. If this is not done, fibers following along with the vapor may precipitate out on the surfaces of the heat exchanger, for example, and thereby deteriorate the heat transfer obtained therein.

In the past attempts have been made to eliminate these problems by blowing the vapor and the fibrous material to a pressure-proof cyclone. In such a cyclone, the fibrous material is separated in a known manner and discharged by a thick-pulp pump, a cell outfeeder or the like, through the lower portion of the cyclone, while the vapors leave through the top of the cyclone. This system, however, involves shortcomings in that a large portion of the vapors are consumed in transporting the material to the cyclone, and in the cyclone operation itself, and furthermore because the investment and operation costs are rather high. As an example, it can be noted that at an overpressure of 1.5 kp/cm$^2$ in the refiner the vapors obtained from the cyclone normally have an overpressure of only 0.75 kp/cm$^2$. There is, consequently, a substantial reduction in the heat content thereof.

Such a system is shown, for example, in FIG. 1 of Finnish patent specification 58171, and in that inventor's improvement shown in FIG. 2 thereof. In particular, in that case there is a pressure-tight connection between the refiner housing and a discharge screw 5 leading from that refiner to a conveyor for removing the cellulosic material in the form of a plug and an outlet 12 including a screw 14 for separating additional cellulosic material from the vapor.

In accordance with the present invention, however, it has been surprisingly discovered that the use of such cyclones can now be entirely replaced by a system which includes an outfeed or discharge chamber in which the fibers settle.

The characterizing features of the present invention will be more fully understood with respect to the following detailed disclosure.

SUMMARY OF THE INVENTION

In accordance with the present invention a method for separating vapor from cellulosic material which has been refined at a predetermined pressure is disclosed, including discharging the refined cellulosic material containing such vapors therein downwardly through an inlet opening into a discharge chamber maintained substantially at that predetermined pressure, deflecting such vapors laterally with respect to the cellulosic material passing downwardly through the inlet opening, passing the vapor through the discharge chamber at a flow rate of less than about 15 meters/sec. whereby cellulosic material carried by that vapor is separated from the vapor by sedimentation, and discharging the cellulosic material from the discharge chamber.

In accordance with one embodiment of the method of the present invention the cellulosic material is discharged from the discharge chamber in the form of a substantially gas-tight material plug which enables maintenance of the discharge chamber at that predetermined pressure of the refiner.

In one embodiment of the present invention the material plug is formed at a location substantially adjacent to the outlet opening of the discharge chamber, and the vapors are deflected in a plurality of directions, with respect to the cellulosic material passing downwardly through the inlet opening, prior to the forming of the material plug. In a preferred embodiment, the discharge chamber includes first and second discharge chamber sections, and the method includes discharging the refined cellulosic material into the first discharge chamber section, passing the vapor through that section, passing the cellulosic material from the first discharge chamber section to the second discharge chamber section, and discharging the material from the second discharge chamber section.

In accordance with the apparatus of the present invention vapors are separated from cellulosic material which has been refined in a refiner maintained at a predetermined pressure, and the apparatus includes a discharge chamber including an inlet adapted to be connected to the outlet of the refiner, and an outlet, the discharge chamber including a portion disposed laterally with respect to the discharge chamber inlet opening, conveyor means for moving the cellulosic material laterally with respect to the discharge chamber inlet opening in a first direction towards the discharge chamber outlet whereby the conveyor moves the cellulosic material to the outlet of the discharge chamber and creates a substantially gas-tight plug of cellulosic material at the outlet so that the discharge chamber can be maintained substantially at the predetermined pressure, the conveyor means including vapor passage means for permitting the vapor to pass laterally with respect to the inlet opening in a second direction, and vapor collection and discharge means located at the portion of the discharge chamber disposed laterally with respect to the inlet passage and displaced from that inlet passage in the second direction, for collecting and discharging the vapor therefrom.

In a preferred embodiment of the apparatus of the present invention the conveyor means coprises a screw conveyor, and the vapor passage means comprises partially open threads on a portion of the screw conveyor located between the inlet of the discharge chamber and the vapor collection and discharge means.

In accordance with another embodiment of the apparatus of the present invention, the discharge chamber includes first and second discharge chamber sections, an inlet to the second section being connected to the outlet of the first section. The conveyor means comprises a first screw conveyor with vapor passage means located in the first discharge chamber section, and a second screw conveyor for creating the plug located in the second discharge chamber section.

BRIEF DESCRIPTION OF THE DRAWINGS

A preferred embodiment of the present invention is described in the following detailed description, which makes reference to the accompanying drawings, in which.

DETAILED DESCRIPTION

Figure 1:
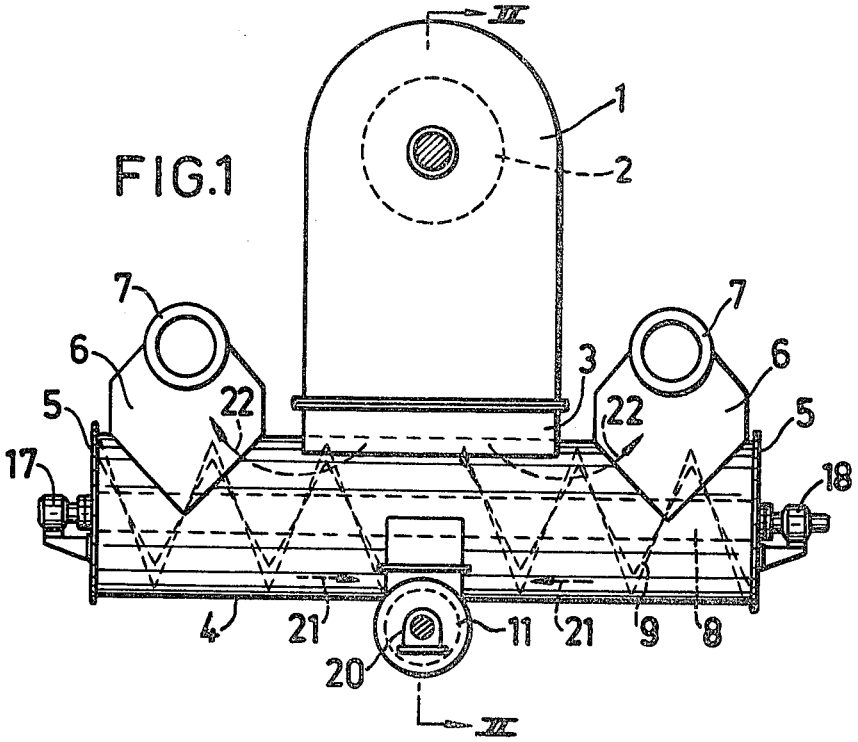
FIG. 1 is a side elevational, partly phantom view of the apparatus of the present invention.

In accordance with the Figures, in which like numerals refer to like portions thereof, a refiner housing 1 is shown, preferably including a pair of counter-rotating discs 2. The refiner cover is connected in a pressure-tight manner to a stud 3 extending from a discharge chamber including an upper trough 4, which is shielded from the surrounding environment by a casing, and end walls 5. A space 6 including an outlet 7 is provided at each end of the trough 4. Inside trough 4, an upper conveyor screw 9 is included with both right hand and left hand threads. The conveyor screw 9 is mounted on a shaft 8 so as to feed material in an axial direction to the center of the trough 4, preferably to a position located substantially directly below the discs 2. An outlet opening 10 is provided at the bottom of trough 4 and connects the trough with another portion of the discharge chamber, i.e., preferably a transverse lower trough 11. This lower trough 11 encloses a conveyor screw 13, which is mounted on a shaft 12. This trough 11 is also defined with respect to the surrounding environment and enclosed at one end by end wall 14. At its other end it is enclosed by a material plug 15 in discharge opening 16. The object of this material plug is explained in more detail below in connection with the description of the method of operation of this apparatus.

Upper conveyor screw 9 is designed with a flat-rolled steel coil, which leaves free space for gas (vapor) to flow axially between that coil and the shaft 8, i.e., it includes partially open threads in that portion thereof. On the other hand, the lower conveyor screw 13 has an unbroken coil, which extends downwardly to the shaft 12 at least in the portion located closest to discharge opening 16 of trough 11 in order to forceably feed the material to that opening 16. The shafts of the conveyor screws are supported in bearings 17, 18 and, respectively, 19, 20, and are driven by conventional sources (not shown). A suitable speed of rotation for screw 9 is from about 5 to 50 r.p.m., and for screw 13 from about 50 to 200 r.p.m.

The apparatus described above operates as follows. The material which is refined between the discs 2 is passed, together with vapor formed therein, to the central portion of trough 4. Here, the material is collected by the conveyor screw 9 in a direction of the arrows 21 shown therein, towards outlet opening 10, from which it flows downwardly into trough 11. The vapors pass off in the direction of arrows 22 shown in FIG. 1 to spaces 6, where they can be discharged from these spaces through outlets 7, for example to an installation for heating water to a suitable temperature. Since the trough 4 and spaces 6 are dimensioned for a low flow rate, generally from about 0.5 to 15 meters/sec., more preferably from about 1 to 5 meters/sec. and most preferably from about 1.5 to 2.5 meters/sec., the small amount of material which follows along with the vapor will be able to settle so that the vapor which is substantially free of fibers is obtained from outlets 7 for further transport or other use. During mill operation fiber content values as low as 50 mg. fiber per kg. vapor have thus been measured. The pressure drop all the way to outlets 7 is substantially zero, which implies that from about 75% to 85% of the energy supplied to the refiner can now be recovered. The only loss is the amount of heat which unavoidably accompanies the heated material.

In troughs 4 and 11 the pressure is substantially the same as in the refiner housing, i.e., from about 0.1 to 6.0 $kg/cm^2$, and preferably from about 0.5 to 4.5 $kg/cm^2$. Usually the pressure is at a value of about 2 $kg/cm^2$. The pressure is maintained in view of the fact that the outlet 16 of trough 11 is sealed by a gas-proof or substantially gas-proof material plug 15, into which the cellulosic material is moved upon rotation of conveyor screw 13 and thus continuously out of outlet 16. It has been found possible to maintain such an efficiently sealing material plug in spite of the lower pressure outside outlet 16.

A number of modifications of the present invention can be made while remaining within the scope thereof. It is thus possible, for example, to eliminate screw conveyor 9 and trough 4, and to thus connect the refiner cover directly to the screw trough 11 in a pressure tight manner, and to thus discharge the vapor to a space in connection with manhole 23. With such a design, the portion of the conveyor screw 13 located beneath the beater cover, and the portion which extends from there all the way to the end wall 14 of the screw trough, can be formed as a flat-rolled steel coil similar to the above-described conveyor screw 9 so as to render discharge of the vapor possible. In order to obtain the necessary low vapor flow rate, the diameter, and possibly the length, of the conveyor screw 13 must be increased as compared with that required in the above embodiments including two conveyor screws.

Figure 2:
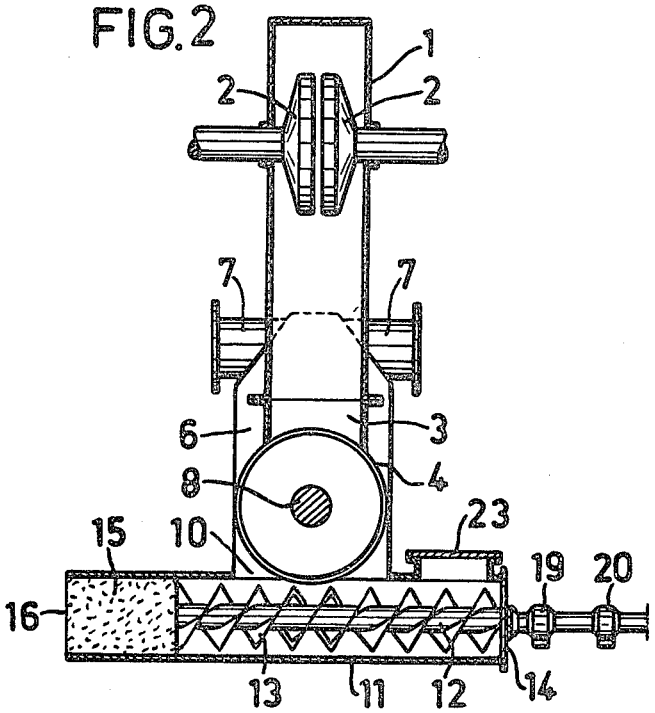
FIG. 2 is a side elevational view of the apparatus of the present invention taken along section II—II of FIG. 1.

It may also be pointed out that the concept of the present invention is not restricted to the embodiments disclosed above. For example, the conveyor screws may be three or more in number, and in the embodiment employing two conveyor screws, the screws do not have to be arranged angularly relative to one another, such as at the right angles shown in FIGS. 1 and 2, but may be in parallel with each other, etc.

What is claimed is:

1. A method of separating vapor from cellulosic material which has been refined at a predetermined elevated pressure comprising discharging said refined cellulosic material containing said vapor downwardly through an inlet opening into a discharge chamber maintained substantially at said predetermined elevated pressure, deflecting said vapor laterally with respect to said cellulosic material passing downwardly through said inlet opening, passing said vapor through said discharge chamber at a flow rate of less than about 15 meters/sec. whereby cellulosic material carried by said vapor is separated from said vapor by sedimentation, separating said vapor from said discharge chamber in a substantially vertical direction, and discharging said cellulosic material from said discharge chamber.

2. The method of claim 1 wherein said cellulosic material is discharged from said discharge chamber in the form of a substantially gas-tight material plug, said substantially gas-tight material plug thereby maintaining said discharge chamber at said predetermined pressure.

3. The method of claim 2 including forming said material plug at a location substantially adjacent to said inlet opening of said discharge chamber, and deflecting said vapor in a plurality of directions, with respect to said cellulosic material passing downwardly through said inlet opening, prior to the forming of said material plug.

4. The method of claim 1 wherein said flow rate of said vapor through said discharge chamber is from about 0.5 to 15 meters/sec.

5. The method of claim 1 wherein said flow rate of said vapor through said discharge chamber is from about 1 to 6 meters/sec.

6. The method of claim 1 wherein said flow rate of said vapor through said discharge chamber is from about 1.5 to 2.5 meters/sec.

7. The method of claim 1 wherein said discharge chamber includes a first discharge chamber section and a second discharge chamber section, and including discharging said refined cellulosic material containing said vapor into said first discharge chamber section and passing said vapor through said first discharge chamber section, passing said cellulosic material from said first discharge chamber section to said second discharge chamber section, and discharging said cellulosic material from said second discharge chamber section.

8. Apparatus for separating vapor from cellulosic material which has been refined in a refiner at a predetermined elevated pressure comprising a discharge chamber including an inlet adapted to be connected to the outlet of said refiner and an outlet, said discharge chamber including a portion disposed laterally with respect to said discharge chamber inlet opening, conveyor means for moving said cellulosic material laterally with respect to said discharge chamber inlet opening in a first direction towards said discharge chamber outlet so as to create a substantially gas-tight plug of cellulosic material at said outlet in order to maintain said discharge chamber substantially at said predetermined elevated pressure, said conveyor means including vapor passage means for causing said vapor to pass laterally with respect to said discharge chamber inlet opening in a second direction and in a direction different from the direction in which said conveyor means moves said cellulosic material, and vapor collection and discharge means located at said portion of said discharge chamber disposed laterally with respect to said discharge chamber inlet opening and displaced from said discharge chamber inlet opening in said second direction for collecting and discharging said vapor therefrom in a substantially vertical direction with respect to said discharge chamber.

9. The apparatus of claim 8 wherein said conveyor means comprises a screw conveyor, and said vapor passage means comprises partially open threads on a portion of said screw conveyor located between said discharge chamber inlet opening and said vapor collection and discharge means.

10. The apparatus of claim 8 wherein said discharge chamber includes a first discharge chamber section and a second discharge chamber section, an inlet to said second discharge chamber section being connected to an outlet of said first discharge chamber section, said conveyor means comprising a first screw conveyor, including said vapor passage means, located in said first discharge chamber section, and a second screw conveyor for creating said gas-tight plug located in said second discharge chamber section.

* * * * *

UNITED STATES PATENT AND TRADEMARK OFFICE

CERTIFICATE OF CORRECTION

PATENT NO. : 4,350,499

DATED : September 21, 1982

INVENTOR(S) : Rolf B. Lundgren

It is certified that error appears in the above-identified patent and that said Letters Patent are hereby corrected as shown below:

Column 5, line 27, "6" should read --5--.

Signed and Sealed this

*Fifteenth* Day of *February 1983*

[SEAL]

*Attest:*

GERALD J. MOSSINGHOFF

*Attesting Officer*

*Commissioner of Patents and Trademarks*